US006263156B1

(12) United States Patent
Ledoux

(10) Patent No.: US 6,263,156 B1
(45) Date of Patent: Jul. 17, 2001

(54) RECYCLING OF AIR HUMIDIFIER CYLINDERS

(76) Inventor: Denis-Michel Ledoux, 62 Fontenay, Lorraine, Quebec (CA), J6Z 1R7

( * ) Notice: Subject to any disclaimer, the term of this patent is extended or adjusted under 35 U.S.C. 154(b) by 0 days.

(21) Appl. No.: 09/647,326

(22) PCT Filed: Mar. 30, 1999

(86) PCT No.: PCT/CA99/00273

§ 371 Date: Sep. 26, 2000

§ 102(e) Date: Sep. 26, 2000

(87) PCT Pub. No.: WO99/50602

PCT Pub. Date: Oct. 7, 1999

Related U.S. Application Data

(60) Provisional application No. 60/080,208, filed on Mar. 31, 1998.

(51) Int. Cl.[7] ..... H05B 3/60

(52) U.S. Cl. ..... 392/337; 392/322

(58) Field of Search ..... 392/337, 311, 392/312, 322, 324, 331, 338

(56) References Cited

U.S. PATENT DOCUMENTS 4,288,684 * 9/1981 Katou et al. ..... 392/335
4,394,561 * 7/1983 Zerbel ..... 392/329

* cited by examiner

*Primary Examiner*—Teresa Walberg
*Assistant Examiner*—Thor Campbell
(74) *Attorney, Agent, or Firm*—Eric Fincham

(57) ABSTRACT

There is provided a method for recycling steam producing cylinders such as used for humidification purposes. The method comprises opening the old cylinder (10), removing the electrodes (12) from respective electrode support rods (16), cleaning the cylinder (10) to remove all deposits therefrom, forming new electrodes (48) of a non magnetic material to have a thermal exchange similar to the removed electrodes (12), soldering the new electrodes (48) to respective electrode support rods (16), and rescaling the cylinder (10).

7 Claims, 4 Drawing Sheets

RECYCLING OF AIR HUMIDIFIER CYLINDERS

This application is a 371 of PCT/CA99/00273 filed Mar. 30, 1999 which claims benefit of provisional app. Ser. No. 60/080,208 filed Mar. 31, 1998.

The present invention relates to humidifiers and more particularly, relates to a method for recycling steam producing cylinders such as are used for humidification purposes.

BACKGROUND OF THE INVENTION

Steam producing humidifiers are utilized in many buildings for maintaining the humidity within the building at a desired level. The steam producing cylinders usually comprise an outer casing or container of a plastic material within which there is placed water and at least two electrodes for passing an electric current through the water to heat the same and thereby produce steam. The outer container or cylinder is made of a material which is resistant to the steam and/or hot water and is usually of a polypropylene material. The electrodes are immersed in the water and alternating current is supplied to the electrode. The current travels through the water and produces the heat which then boils the water.

For any given voltage, the amount of current determines the amount of steam produced. Generally, for new cylinders, it is established that approximately 1 pound of steam requires ⅓ of a kilowatt of electrical energy.

A major problem associated with the steam producing cylinders is scaling of the electrodes and other parts. In an attempt to minimize this problem, purging of the containers at regular intervals is recommended and required.

As will be understood, the continuous boiling of the water leaves an increased mineral accumulation in the remaining water. This mineral accumulation increases the conductivity of the water and thus the amount of current flowing. However, this also results in the scaling of the electrodes and in turn, the scaling on the electrodes acts as a insulating layer thus decreasing the efficiency of the steam producing cylinder.

It is well understood that given a certain voltage, the value of the current will change depending on various parameters including the size of the cylinder and/or the amount of the water for a given electrode size. One can also change the conductivity of the water as above mentioned wherein the current will increase in proportion to the water conductivity. One can also vary the space between the electrodes and/or vary the size and thickness of the electrodes.

The source of the water itself will be a factor in the operation of the steam producing cylinder. Thus, the amount of dissolved minerals will vary from one city to another as well as from one well to another. As aforementioned, purging the cylinders is required at frequent levels.

The calcification on electrodes is one problem. Deposits also form on the inner walls of the container and some of the deposits from the electrodes and/or the inner water walls may separate and accumulate on a mesh or screen filter at the bottom of the cylinder. Naturally, blocking the mesh filter will accelerate the rate of deposits due to lack of purging and eventually plug the entire cylinder rendering it inoperable. Furthermore, one may find cylinders which are partially melted due to arcing and some cylinders have been known to catch fire or even explode.

Apart from the straight scaling problem, corrosion is a further problem which eats away at the electrodes. These electrodes are of a ferrous material and are susceptible to arcing between electrodes. This arcing can weaken and destroy the electrodes.

The electrodes themselves are normally of a perforated material which increases the circulation and contact with water that travels through the apertures or pores in the electrode. However, the apertures and pores rapidly become clogged due to scaling and indeed, the small size thereof renders them very susceptible to the same.

For the reasons mentioned above, the steam generating often become inoperable and must be completely discarded. Often, due to the scaling problems, the electrodes damage separators which are used within the cylinders and the cylinders must be discarded.

It has been proposed in the art to help overcome the problem of scaling by coating the electrodes with various materials. While such methods have achieved varying degrees of success, they have not been widely adopted.

Conventional constructions of electrodes seen in the prior art are shown, for example, in U.S. Pat. No. 4,288,684. However, this patent does not teach any recycling of steam generating cylinders.

SUMMARY OF THE INVENTION

It is therefore an object of the present invention to provide a method for recycling steam generating cylinders used for the production of steam.

It is a further object of the present invention to provide an improved steam generating cylinder which is less susceptible to scaling and clogging.

According to one aspect of the present invention, there is provided a method of recycling steam producing cylinders having a plurality of electrodes mounted on respective electrode support rods, and which cylinders have deposits formed therein, the method comprising the steps of a) opening the cylinder, b) removing the electrodes from respective electrode support rods; c) cleaning the cylinder to remove all deposits therefrom; d) forming new electrodes of a non magnetic material to have a thermal exchange similar to the electrodes removed in step (b); e) soldering the new electrodes to respective electrode support rods; and f) resealing the cylinder.

As aforementioned, the known electrodes used in the steam generating cylinders are formed of a magnetic material—i.e. a ferrous material. The reason for the use of a magnetic material is that an electrode formed of such materials is an excellent conductor of electrical energy. Generally, such materials will have an average electrical resistance at 20° C. of less than 60 microhm-cm.

According to the present invention, the electrodes are made of a non ferrous and non magnetic material. Once such desirable material is 300 series stainless steel. Although this material normally has a higher electrical resistance (72–74 microhm-cm) compared to known materials, it has been found that cylinders using such electrodes have substantial advantages. The material has been found to be as efficient as the known magnetic or ferrous material conventionally used since within only a few weeks of operation, the conventional electrodes accumulate sufficient scaling to have a resistance higher than that of the non magnetic electrode.

It has been found that the life span of cylinders using the non magnetic electrodes is an average of three times longer than the ferrous electrodes. In addition, the non ferrous electrodes provide a large energy savings.

A further advantage of the electrodes of the present invention is a reduction in bio-contaminants. Scale is a very porous material which actively promotes the incubation of bio-contaminants including various bacteria, yeast, molds, viruses, protozoa, antigens, algae and endotoxins. The electrodes of the present invention do not suffer from this disadvantage and a simple cleaning of the cylinders with a weak acid minimizes the problem with bio-contaminants.

In a preferred embodiment of the present invention, the conventional circular electrodes are replaced by a diamond shaped electrode. Once one calculates the electrical resistant values, the electrodes may be formed in the desired configuration.

The method of the present invention provides for recycling of the steam producing generators. This reduces the amount of waste as the cylinders are normally completely discarded. In accordance with the method of the present invention, the cylinders are recycled.

Generally, most cylinders are of a sealed configuration although there are a few commercially available cylinders which may be open and subsequently closed and sealed. In the practice of the method of the invention, the cylinder is opened (if so constructed) or otherwise cut open along the cylinder circumference. The electrodes (and the electrode rods in certain cases) are removed.

Subsequently, the interior of the cylinder may be cleaned mechanically and can be followed by placing the cylinder in a solution of phosphoric acid which is environmentally friendly. New electrodes are then formed and bent to a diamond shape. The electrodes are then placed on the existing electrode rods (or new rods are installed if required). The electrodes are soldered to the electrode rods and the cylinder is subsequently froze and secured together, normally using a polypropylene plastic soldering gun and polypropylene cord.

BRIEF DESCRIPTION OF THE DRAWINGS

Having thus generally described the invention, reference will be made to the accompanying drawings illustrating embodiments of the invention, in which.

DESCRIPTION OF THE PREFERRED EMBODIMENTS

Figure 1:
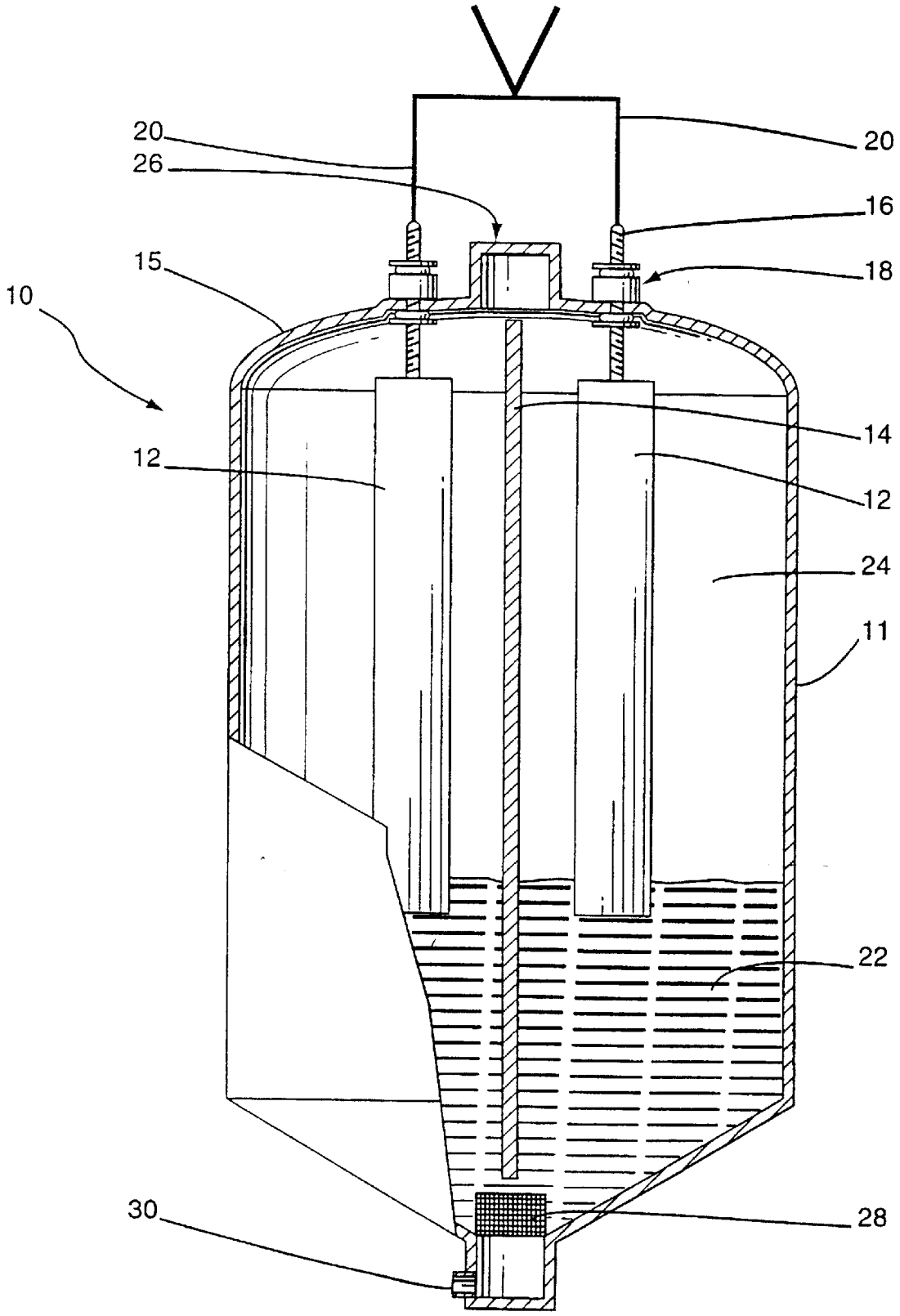
FIG. 1 is a side elevational view, partially in section, of a typical steam producing cylinder used for humidification purposes.

Referring to the drawings in greater detail, there is illustrated in FIG. 1 a conventional steam producing cylinder such as may be used for humidification purposes. Cylinder 10 has a side wall 11 which is of a generally cylindrical configuration. In the illustrated embodiment, a pair of electrodes 12 are mounted interiorly of cylinder 10 with a separator 14 therebetween. As previously mentioned, any number of such electrodes may be supplied.

Each electrode 12 is mounted on an electrode supply and support rod 16 which passes through an upper wall 15 of cylinder 10 and is sealed as indicated by reference numeral 18.

Appropriate electrical supply lines 20 are operatively connected to electrical supply and support rods 16.

Cylinder 10 has a bottom part occupied by water 22 above which there is a steam chamber 24. A steam outlet 26 is provided in upper wall 15 of cylinder 10.

At the bottom of cylinder 10, there is provided a drainage opening 30 for purging the cylinder 10 when required.

Figure 2:
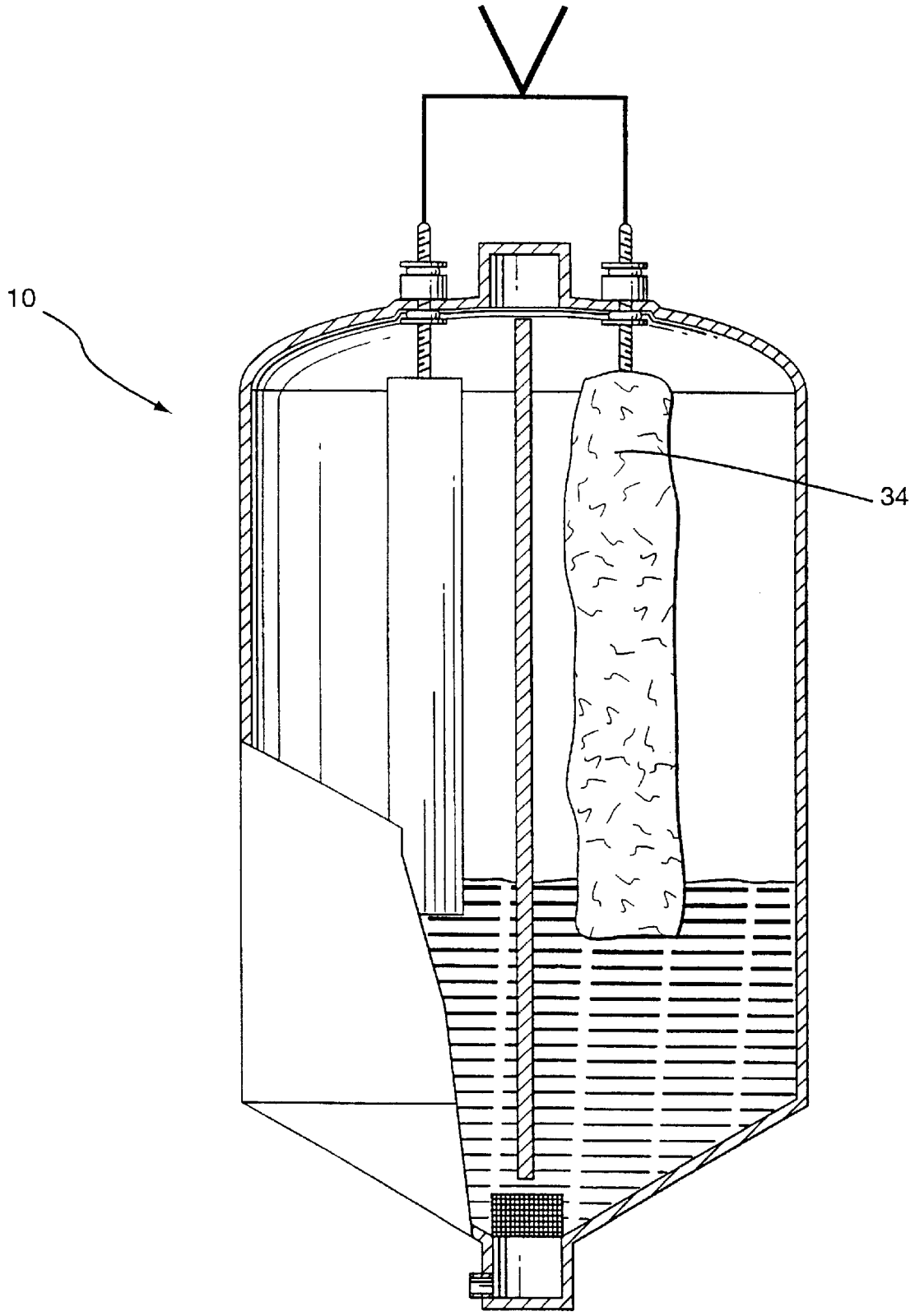
FIG. 2 is a view similar to FIG. 1 illustrating the first stages of scaling.

FIG. 2 illustrates a first stage of deterioration in which scale 34 starts to form on one of electrodes 12.

Figure 3:
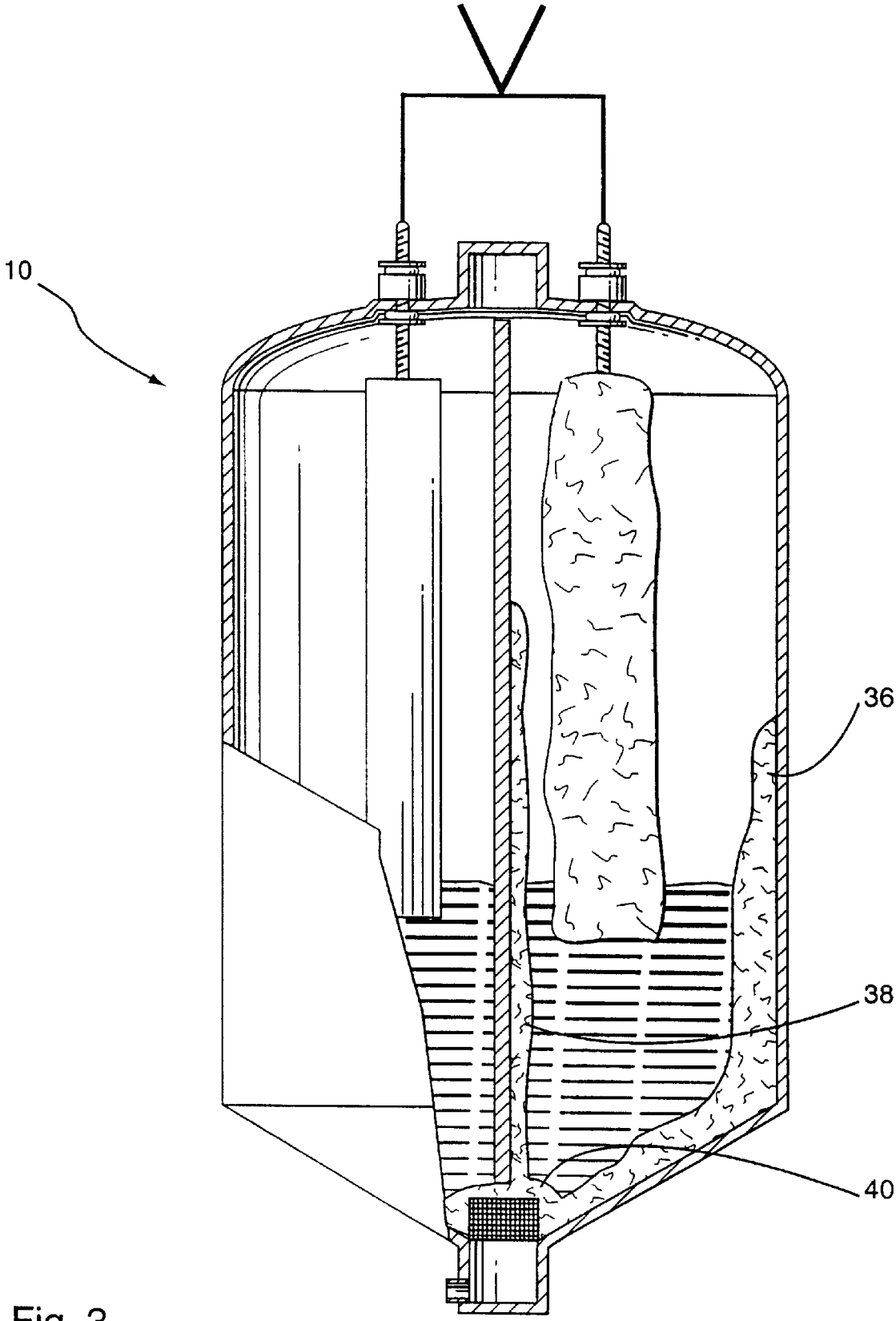
FIG. 3 is a view similar to FIG. 1 illustrating the scaling at a more advanced stage.

In FIG. 3, a more advanced stage of scaling is shown wherein there is additional scale 36 which forms on wall 11 as well as scale 38 on separator 14. As a result of the scale formation, debris 40 may block screen filter 28.

Figure 4:
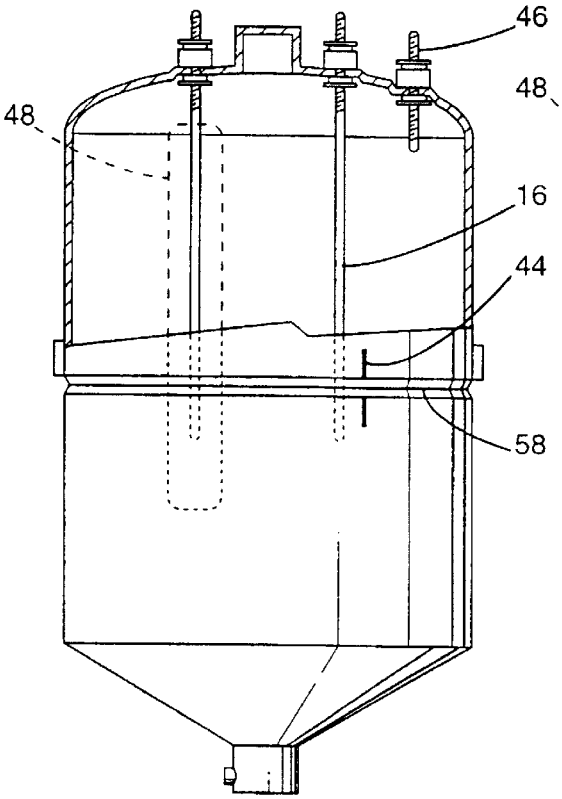
FIG. 4 is a side elevational view, partially in cutaway, of one type of steam producing cylinder which has been recycled.
Figure 5:
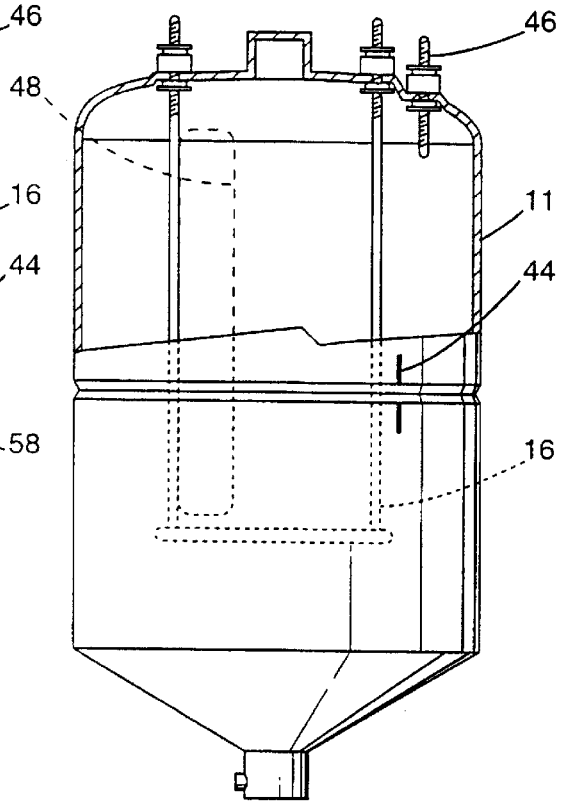
FIG. 5 is a side elevational view similar to FIG. 4 illustrating a slightly different type of steam producing cylinder which has been recycled.
Figure 6:
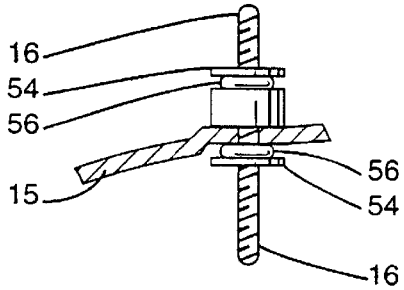
FIG. 6 is a detailed side elevational view of an electrical supply and support rod.

FIGS. 4 to 6 illustrate the modifications made to the cylinders for purposes of recycling the same. It will be understood that as many different cylinders have slightly different configurations and methods of manufacturing, some minor modifications to the process may be required.

In FIGS. 4 to 6, reference numerals similar to those used in FIGS. 1 to 3 are used for similar components.

In the embodiment of FIG. 4, the side wall 11 is cut circumferentially after marking a reference alignment mark 44 so as to provide an upper and lower body portion. Subsequently, electrodes 12 are removed from electrical supply and support rods 16. Scale 36 on cylinder 10 and scale 38 on separator 14 as well as deposits or debris 40 on screen 26 are removed, preferably by water jet. If need be, separator 14 and/or electrode supply and support rods 16 may be removed and replaced. The cylinder is also preferably soaked in a phosphoric acid to assist in removal of all scaling on electrodes.

Figure 4A:
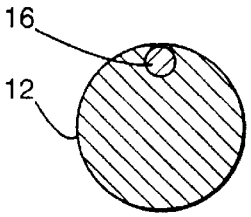
FIG. 4A is a top plan view of an original electrode.
Figure 4B:
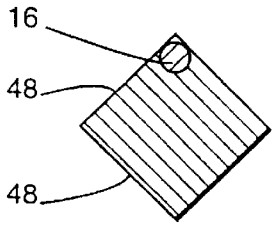
FIG. 4B is a top plan view of a replacement electrode.

As shown in FIG. 4A, electrodes 12 are normally of a circular configuration and attached to electrode supply and support rod 16. According to the present invention, a new electrode 48 of a diamond configuration is spot welded to electrical supply and support rod 16. Electrode 48 is of a non magnetic material as previously described.

The upper and lower portions of cylinder 10 may then be reassembled with alignment being done by means of an alignment mark 44.

As will be noted in the embodiment of FIG. 4, there is provided a high water level electrode, as is known in the art, and which is generally designated by reference numeral 46.

In the embodiment of FIG. 5, a similar process is followed with the difference that in this particular type of cylinder, there is provided a bottom electrode support 50.

As shown in FIG. 6, at the point where electrode support rod 16 passes through upper wall 15, there may be provided washers 54 with sealing elements 56 mounted on the rod in a conventional manner.

For reassembling the two portions of the cylinder together, at the point where the walls meet, each may be beveled inwardly so as to form an angle of approximately 60° as indicated by reference numeral 58. Subsequently, a plastic welding material may be placed in the V-groove thus formed and the cylinder portions welded together.

As an addition to the above, an insulating jacket may be formed about the exterior of the cylinder to thereby conserve energy when the cylinders are used.

I claim:

1. A method of recycling a steam producing cylinder (10) having a plurality of electrodes (12) mounted on respective electrode support rods (16), and which cylinders have deposits (36, 38) formed therein, the method comprising the steps of:

a) opening said cylinder (10);

b) removing said electrodes (12) from respective electrode support rods (16);

c) cleaning said cylinder (10) to remove all deposits therefrom;

d) forming new electrodes (48) formed of a non magnetic material to have a thermal exchange similar to said electrodes (12) removed in step (b);

e) soldering said new electrodes (48) to respective electrode support rods (16); and f) resealing said cylinder (10).

2. The method of claim 1 wherein said step of opening said cylinder comprises the step of cutting a cylinder wall to form two container parts and subsequently, in step (f), sealing said two container parts together.

3. The method of claim 1 wherein step (b) additionally includes the step of removing said electrode support rods (16) and replacing said electrode support rods with new electrode support rods prior to step (e).

4. The method of claim 1 wherein said step of cleaning said cylinder to remove all deposits therefrom comprises the step of using water jets to remove material and soaking said cylinders in a phosphoric acid solution.

5. The method of claim 1 wherein said step of forming new electrodes of a non magnetic material comprises forming said electrodes in a diamond configuration.

6. The method of claim 5 wherein said electrodes are formed of 300 series stainless steel.

7. The method of claim 2 wherein said step (f) comprises forming a V-shaped recess where said container wall was cut and inserting plastic welding material therein.

* * * * *